US009988777B2

(12) United States Patent
Lee

(10) Patent No.: US 9,988,777 B2
(45) Date of Patent: Jun. 5, 2018

(54) ROAD GUIDE POST

(71) Applicant: Sang Pyo Lee, Gwacheon-si (KR)

(72) Inventor: Sang Pyo Lee, Gwacheon-si (KR)

( * ) Notice: Subject to any disclaimer, the term of this patent is extended or adjusted under 35 U.S.C. 154(b) by 0 days. days.

(21) Appl. No.: 15/541,352

(22) PCT Filed: May 19, 2015

(86) PCT No.: PCT/KR2015/005015

§ 371 (c)(1),
(2) Date: Jun. 30, 2017

(87) PCT Pub. No.: WO2016/148339

PCT Pub. Date: Sep. 22, 2016

(65) Prior Publication Data

US 2018/0002878 A1 Jan. 4, 2018

(30) Foreign Application Priority Data

Mar. 17, 2015 (KR) ..... 10-2015-0036551

(51) Int. Cl.

| | |
|---|---|
| ***E01F 9/60*** | (2016.01) |
| ***E01F 9/627*** | (2016.01) |
| ***E01F 9/608*** | (2016.01) |
| ***E01F 9/681*** | (2016.01) |

(52) U.S. Cl.
CPC ..... *E01F 9/629* (2016.02); *E01F 9/608* (2016.02); *E01F 9/681* (2016.02)

(58) Field of Classification Search
CPC ..... E01F 9/629; E01F 9/608; E01F 9/681
See application file for complete search history.

(56) References Cited

U.S. PATENT DOCUMENTS 3,040,636 A * 6/1962 Simm ..... E01F 9/681 248/158
3,858,997 A * 1/1975 Boone ..... E01F 9/61 116/63 R
3,902,818 A * 9/1975 Boone ..... E01F 9/61 404/10
4,269,534 A * 5/1981 Ryan ..... E01F 9/681 256/1

(Continued)

FOREIGN PATENT DOCUMENTS

JP 2007-291828 A 11/2007
KR 10-0827373 B1 5/2008

(Continued)

OTHER PUBLICATIONS

KR Notification of Reason for Refusal dated Jun. 8, 2015 as received in Application No. 10-2015-0036551 (English Translation).

(Continued)

*Primary Examiner* — Abigail A Risic
(74) *Attorney, Agent, or Firm* — Maschoff Brennan

(57) ABSTRACT

A road guide post includes: a supporter which is fixed to the ground by being coupled to an anchor bolt; a guide post body which has a post shape that is screw-coupled to or fitted into the supporter; reflective sheets, multiple layers of which are attached to the concave groove part of the guide post body; and a bracket which is inserted and fixed into the bottom surface of the supporter.

1 Claim, 8 Drawing Sheets

(56) References Cited

U.S. PATENT DOCUMENTS 4,511,281 A * 4/1985 Schmanski ..... E01F 9/602 404/10
4,611,949 A * 9/1986 Schmanski ..... E01F 13/06 404/10
4,806,046 A * 2/1989 Clark ..... A63C 19/062 40/608
5,026,204 A * 6/1991 Kulp ..... E01F 9/692 116/63 P
5,201,599 A * 4/1993 Kulp ..... E01F 9/692 116/63 P
5,788,405 A * 8/1998 Beard ..... E01F 9/692 116/63 P
5,888,016 A * 3/1999 Ahn ..... E01F 9/692 116/63 C
5,908,262 A * 6/1999 Ahn ..... E01F 9/675 116/63 P
6,019,543 A * 2/2000 Junker ..... E01F 9/573 116/63 R
6,616,369 B2 * 9/2003 Clark ..... E01F 9/681 116/63 R
7,025,527 B2 * 4/2006 Mecham ..... E01F 9/553 404/10
8,282,309 B2 * 10/2012 Mettler ..... E01F 15/146 404/10
9,713,760 B2 * 7/2017 Peacock ..... A63C 19/062
2004/0084580 A1 * 5/2004 Curtis ..... E01F 9/681 248/158
2008/0295375 A1 * 12/2008 Intagliata ..... G09F 15/0037 40/608
2008/0315062 A1 * 12/2008 Salman ..... E01F 9/681 248/519
2016/0040374 A1 * 2/2016 Shin ..... E01F 9/681 404/10
2016/0090703 A1 * 3/2016 Torres ..... E01F 9/608 404/6
2016/0160460 A1 * 6/2016 Navarro Torres ..... E01F 9/608 404/6

FOREIGN PATENT DOCUMENTS

KR 10-2011-0084777 A 7/2011
KR 10-1397673 B1 5/2014

OTHER PUBLICATIONS

KR Grant of Patent dated Oct. 19, 2015 as received in Application No. 10-2015-0036551 (English Translation).

* cited by examiner

ROAD GUIDE POST

TECHNICAL FIELD

The present invention relates to a road guide post installed on the road or the like to allow drivers to easily identify the centerline or other structures which need to be identified, and more particularly, to a new road guide post capable of improving durability to enhance restoring force and supporting force.

BACKGROUND ART

In general, road guide posts correspond to a type of safety equipment provided on the road. Road guide posts are often installed at places with high risk of traffic accidents or places requiring provision of warnings to drivers and are used to spatially divide traffic lanes or to notify drivers of danger.

The road guide post includes a base fixed to the ground using anchor bolts, and a guide post body vertically coupled to the base and including reflective sheets adhered to the outer circumferential surface thereof.

According to the regulations of the Ministry of Land, Infrastructure and Transport, a standard form of a road guide post includes an orange body including two or three reflective sheets adhered thereto and having a width of 80 mm and a length of 450 mm or 750 mm depending on the speed of vehicles on the road, and a base having a width of 200 mm to 250 mm.

However, a conventional road guide post is easily broken at extremely low temperature and cannot maintain resilience, and anchor bolts which directly receive external impact are easily detached from the ground.

Specifically, in the conventional road guide post, a base has little resilience and thus is easily broken due to impact, has a low coupling force with anchor bolts, and has poor overall durability.

DISCLOSURE

Technical Problem

Therefore, the present invention has been made in view of the above problems, and it is one object of the present invention to provide a new road guide post capable of improving durability.

It is another object of the present invention to provide a road guide post capable of solving problems in that a base has little resilience and thus is easily broken due to impact, has a low coupling force with anchor bolts, and is easily breakable at extremely low temperature.

It is yet another object of the present invention to provide a road guide post capable of enhancing restoring force and supporting force, of being easily installed, and of enabling easy replacement of reflective sheets.

Technical Solution

In accordance with one aspect of the present invention, provided is a road guide post including a base 110 fixed to a ground by fastening anchor bolts 10 and configured as a hemispherical body, a guide post body 120 configured as a rod-shaped body to be screwed or fitted into the base 110, and including reflective sheet adhering grooves 121 provided in an upper outer surface of the rod-shaped body, reflective sheets 130 adhered to the reflective sheet adhering grooves 111 of the guide post body 120 in multiple layers, and a bracket 140 inserted into and fixed to a bottom surface of the base 110 and used to enhance coupling force of the anchor bolts 10.

The base 110 may include a hemispherical base part 111 configured as a hemispherical body, and including a coupling part 111*a* protruding from a top center of the hemispherical body so as to screw or fit the guide post body 120 thereinto, and convex molded parts 110*b* protruding from an outer surface of the hemispherical body so as to enhance restoring force, and a fastening part 112 integrally extending downward and protruding outward from the hemispherical base part 111, and including fastening holes 112*a* for fastening the anchor bolts 10, a bracket mounting groove 112*b* provided under the fastening part 112 to insert and mount the bracket 140 thereinto, and bracket fixing taps 112*c* protruding from a bottom surface of the fastening part 112 to fix the bracket 140 inserted into the bracket mounting groove 112*b*, and the base may be produced by injection-molding a mixture of synthetic rubber or low-density synthetic resin and an anti-hardening agent, and thus is not broken and maintains resilience at extremely low temperature.

The reflective sheet adhering grooves 121 of the guide post body 120 may have a depth of 10 to 15 mm to prevent the reflective sheets 130, which are provided in multiple layers, from protruding from an outer surface of the guide post body 120 and to protect the reflective sheets 130, the guide post body 120 may further include a base coupling part 122 protruding from a bottom surface of the guide post body 120 so as to be screwed or fitted into the base 110, and the guide post body may be produced by injection-molding soft polyurethane or synthetic rubber, so as to have restoring force based on maintenance of resilience The reflective sheets 130 may be adhered to the reflective sheet adhering grooves 121 of the guide post body 120 using a strong adhesive and then a plurality of other reflective sheets may be individually wound therearound in multiple layers without using an adhesive in such a manner that the reflective sheets are replaceable by removing outermost layers, the reflective sheets may be adhered to the reflective sheet adhering grooves 121 of the guide post body 120 using a strong adhesive and then a plurality of other reflective sheets may be adhered thereto in multiple layers using a weak adhesive in such a manner that the reflective sheets are replaceable by removing outermost layers, or long reflective sheets may be wound in multiple layers around the reflective sheet adhering grooves 121 of the guide post body 120 in such a manner that the reflective sheets are replaceable by cutting off outermost parts.

The bracket 140 may be configured as a ring-shaped body including fastening through holes 141 for fastening the anchor bolts 10, or configured as a ring-shaped body including fastening through holes 141 for fastening the anchor bolts 10, and hook-shaped base fixing taps 142 protruding upward from the ring-shaped body, and the bracket may be made of any one selected among aluminum, stainless steel, and galvanized steel not only to enhance supporting force of the anchor bolts 10 but also to prevent corrosion of the bracket.

Advantageous Effects

According to the present invention, a new road guide post capable of improving durability may be provided. Restoring force and supporting force may be enhanced, the road guide post may be easily installed, and reflective sheets may be easily replaced.

Furthermore, problems in that a base of a conventional road guide post has little resilience and thus is easily broken due to impact, and has a low coupling force with anchor bolts may be solved. A problem that the conventional road guide post is easily breakable at extremely low temperature may also be solved.

Compared to the conventional base, the base according to the present invention may be configured to absorb external impact to minimize detachment of anchor bolts, which are used to fix the base to the ground, from the ground, and may exert strong restoring force due to the shape and resilience of a hemispherical body to restore the guide post to an upright position. Reflective sheets may be immediately replaced, and detachment of the anchor bolts, which are used to fix the base to the ground, from the ground due to external impact may be prevented.

BEST MODE

Figure 1:
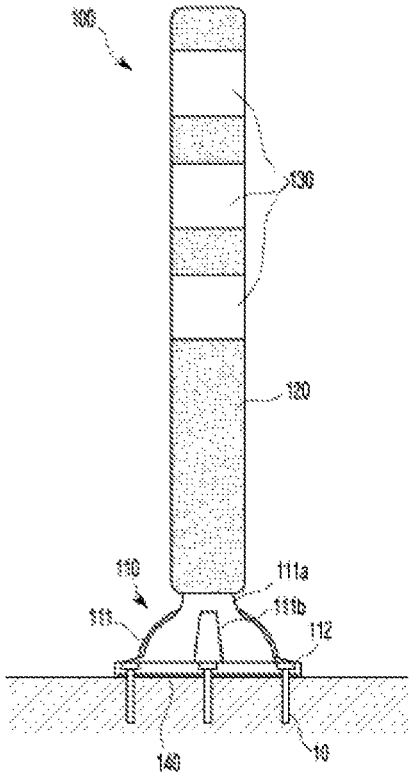
FIG. 1 is a side view showing an installed state of a road guide post according to an embodiment of the present invention.

The present invention will now be described more fully with reference to the accompanying drawings, in which embodiments of the invention are shown. The invention may, however, be embodied in many different forms and should not be construed as being limited to the embodiments set forth herein; rather, these embodiments are provided so that this disclosure will be thorough and complete, and will fully convey the concept of the invention to one of ordinary skill in the art.

The terminology used herein is for the purpose of describing particular embodiments and is not intended to limit the invention. As used herein, the singular forms "a", "an", and "the" are intended to include the plural forms as well, unless the context clearly indicates otherwise. It will be further understood that the terms "comprises" and/or "comprising", when used in this specification, specify the presence of stated features, integers, steps, operations, elements, and/or components, but do not preclude the presence or addition of one or more other features, integers, steps, operations, elements, components, and/or groups thereof.

Unless defined differently, all terms used in the description including technical and scientific terms have the same meaning as generally understood by one of ordinary skill in the art. Terms as defined in a commonly used dictionary should be construed as having the same meaning as in an associated technical context, and unless defined in the description, the terms are not ideally or excessively construed as having formal meaning.

Hereinafter, the present invention will be described in detail by explaining embodiments of the invention with reference to the attached drawings.

As illustrated in FIGS. 1 to 6, a road guide post 100 according to an embodiment of the present invention includes a base 110, a guide post body 120, reflective sheets 130, and a bracket 140.

The base 110 is fixed to the ground by fastening anchor bolts 10, and is configured as a hemispherical body to have restoring force.

The base 110 may be produced by injection-molding a mixture of synthetic rubber or low-density synthetic resin and an anti-hardening agent, and thus may not be broken and maintain resilience at extremely low temperature.

Specifically, the base 110 includes a hemispherical base part 111 and a fastening part 112 integrally extended from the hemispherical base part 111.

In this case, the hemispherical base part 111 is configured as a hemispherical body, and includes a coupling part 111*a* protruding from the top center of the hemispherical body so as to screw or fit the guide post body 120 thereinto, and convex molded parts 111*b* protruding from the outer surface of the hemispherical body so as to enhance restoring force.

The convex molded parts 111*b* have a nearly linear block structure in a radial direction along the outer circumference of the hemispherical body and are provided at equal intervals, thereby enhancing restoring force using resilience thereof. As illustrated in FIGS. 1 to 6, four convex molded parts 111*b* may be provided in four cardinal directions.

The fastening part 112 integrally extends downward and protrudes outward from the hemispherical base part 111, and includes fastening holes 112*a* for fastening the anchor bolts 10, a bracket mounting groove 112*b* provided under the fastening part 112 to insert and mount the bracket 140 thereinto, and bracket fixing taps 112*c* protruding inward from the bottom surface of the fastening part 112 to fix the bracket 140 inserted into the bracket mounting groove 112*b*.

As illustrated in FIGS. 1 to 6, four fastening holes 112*a* and four bracket fixing taps 112*c* may be provided in four cardinal directions, and may be alternately provided to prevent interference therebetween.

The guide post body 120 is configured as a rod-shaped hollow body to be screwed into the base 110, and may be produced by injection-molding soft polyurethane or synthetic rubber, so as to have restoring force based on maintenance of resilience.

The guide post body 120 includes reflective sheet adhering grooves 121 provided in the upper outer surface of the rod-shaped body, and a base coupling part 122 protruding from the bottom surface of the rod-shaped body so as to be screwed or fitted into the base 110.

In this case, the coupling part 111*a* protruding from the top center of the hemispherical base part 111, and the base coupling part 122 protruding from the bottom surface of the guide post body 120 have coupling structures corresponding to each other.

Figure 2:
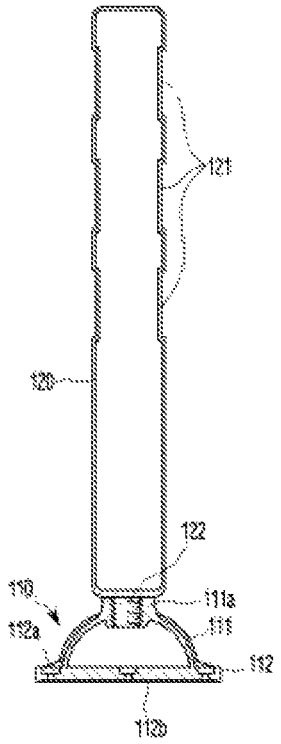
FIG. 2 is a cross-sectional view of a base and a guide post body coupled to the base, in the road guide post according to an embodiment of the present invention.

FIG. 2 shows a screwing structure therebetween. The coupling part 111*a* may be configured as a female screw, and the base coupling part 122 may be configured as a male screw.

Figure 3:
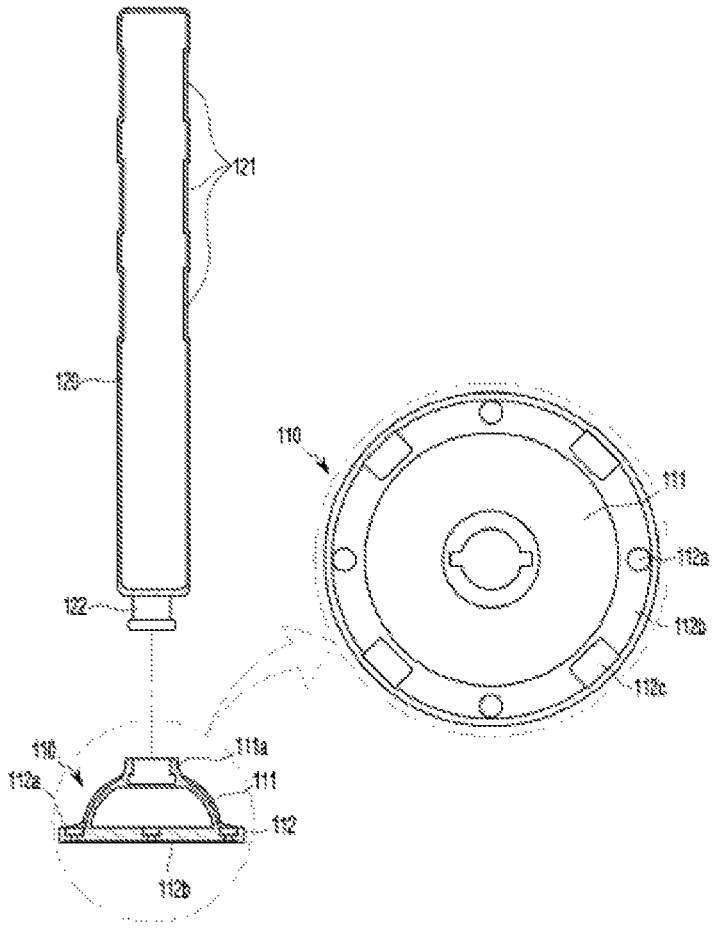
FIG. 3 is a cross-sectional view of another example of the guide post body in the road guide post according to an embodiment of the present invention.
Figure 4:
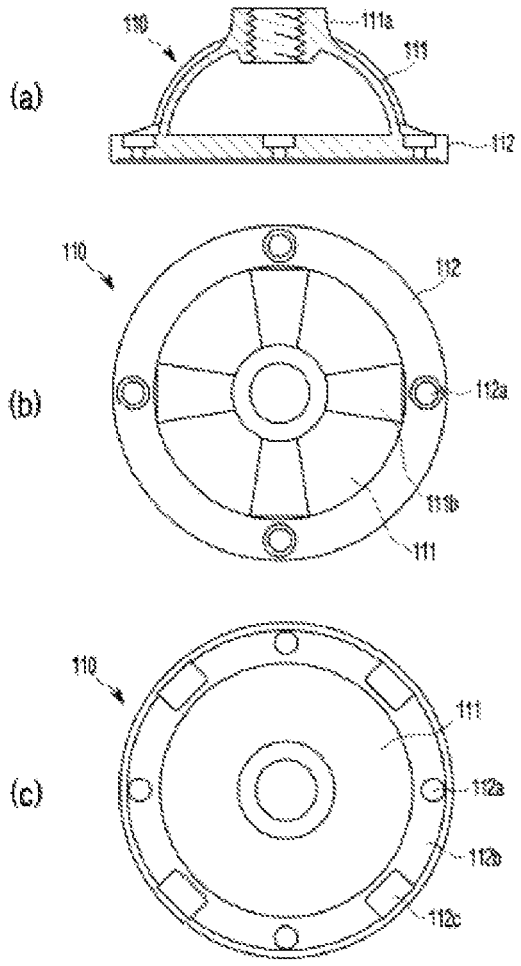
FIG. 4 includes detailed views of the base in the road guide post according to an embodiment of the present invention. Specifically, FIG. 4(*a*) is a cross-sectional view, FIG. 4(*b*) is a plan view, and FIG. 4(*c*) is a bottom view.

FIG. 3 shows an insertion structure therebetween. The coupling part 111*a* may be configured as a linear recess, and the base coupling part 122 may be configured as an insertion tap.

The reflective sheet adhering grooves 121 may have a depth of 10 to 15 mm to prevent the reflective sheets 130, which are provided in multiple layers, from protruding from the outer surface of the guide post body 120 and to protect the reflective sheets 130.

The reflective sheets 130 are adhered to the reflective sheet adhering grooves 111 of the guide post body 120, and are used to prevent traffic accidents by ensuring visibility of drivers.

The reflective sheets 130 may be multilayered to be easily replaced when the reflective sheets 130 wear out. The reflective sheets 130 may be adhered to the reflective sheet adhering grooves 121 of the guide post body 120 using a strong adhesive and then a plurality of other reflective sheets 130 may be wound therearound in multiple layers without using an adhesive in such a manner that the reflective sheets 130 may be easily replaced by removing the outermost layers when the reflective sheets 130 wear out.

Alternatively, the reflective sheets 130 may be adhered to the reflective sheet adhering grooves 121 of the guide post body 120 using a strong adhesive and then a plurality of other reflective sheets 130 may be individually adhered thereto in multiple layers using a weak adhesive in such a manner that the reflective sheets 130 may be easily replaced by removing the outermost layers when the reflective sheets 130 wear out.

Otherwise, long reflective sheets 130 may be wound in multiple layers around the reflective sheet adhering grooves 121 of the guide post body 120 in such a manner that the reflective sheets 130 may be easily replaced by cutting off the outermost parts when the reflective sheets 130 wear out.

The bracket 140 is inserted into and fixed to the bottom surface of the base 110, and is used to enhance coupling force of the anchor bolts 10 which are used to fix the base 110 to the ground.

That is, the bracket 140 is inserted into and fixed to the bracket mounting groove 112*b* provided under the base 110.

The bracket 140 may be made of an anti-corrosion metal such as aluminum, stainless steel, or galvanized steel not only to enhance supporting force of the anchor bolts 10 but also to prevent corrosion of the bracket 140.

Figure 5:
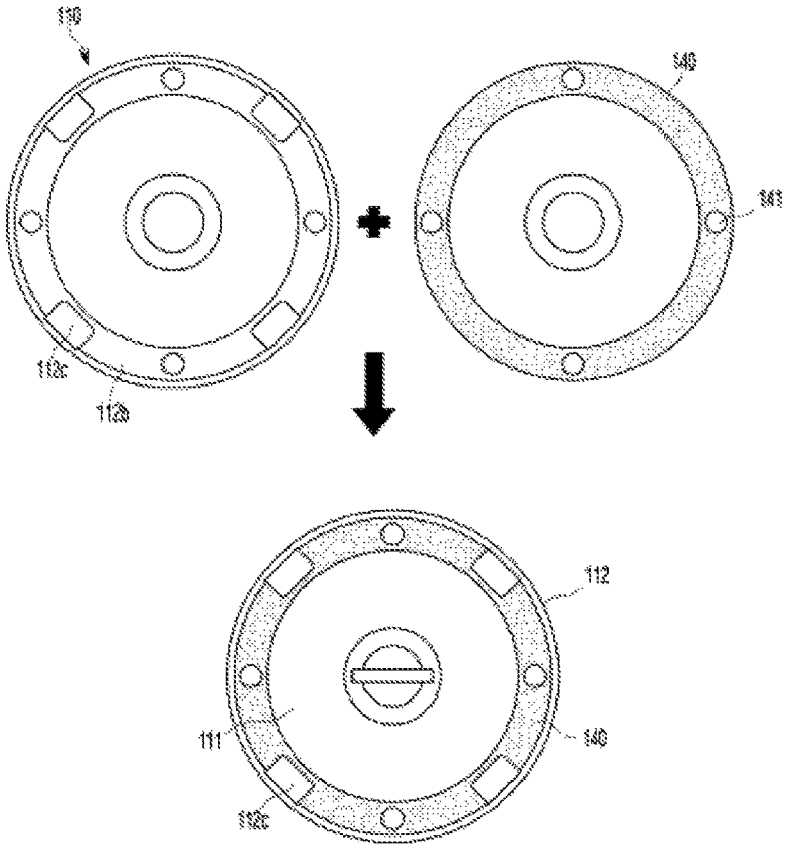
FIG. 5 is a view for describing a coupled state of the base and a bracket in the road guide post according to an embodiment of the present invention.

In this case, as illustrated in FIG. 5, the bracket 140 is configured as a ring-shaped body, and fastening through holes 141 for fastening the anchor bolts 10 are provided therein.

The fastening through holes 141 of the bracket 140 may be provided to have locations and number corresponding to those of the fastening holes 112*a* of the base 110.

Figure 6:
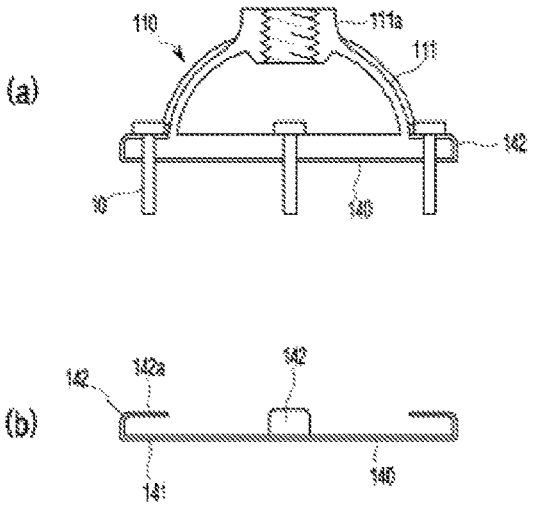
FIG. 6 includes detailed views of another example of the bracket in the road guide post according to an embodiment of the present invention. Specifically, FIG. 6(*a*) is a cross-sectional view showing a coupled state of the base, and FIG. 6(*b*) is a side view.

Alternatively, as illustrated in FIG. 6, the bracket 140 may be configured as a ring-shaped body including the fastening through holes 141 for fastening the anchor bolts 10, and hook-shaped base fixing taps 142 integrally protruding upward from the ring-shaped body.

In this case, the base fixing taps 142 may protrude from locations where the fastening through holes 141 are provided, and fastening holes 142*a* for fastening the anchor bolts 10 may be provided in the base fixing taps 142 along the same axes as the fastening through holes 141.

If the bracket 140 includes the base fixing taps 142, the bracket fixing taps 112*c* provided on the bottom surface of the fastening part 112 of the base 110 may be removed.

If both the base fixing taps 142 and the bracket fixing taps 112*c* are used, the base fixing taps 142 and the bracket fixing taps 112*c* may be provided in locations preventing interference therebetween.

In the above-described road guide post 100 according to the present invention, since the base 110 is configured as a hemispherical body, when the guide post body 120 is hit and bent or the base 110 is run over by a vehicle, the hemispherical body is dented to absorb external impact and thus detachment of the anchor bolts 10, which are used to fix the base 110 to the ground, from the ground may be minimized.

Then, the dented base 110 exerts strong restoring force due to the shape and resilience of the hemispherical body and thus is immediately restored to the original shape thereof. Due to the restoring force, the guide post body 120 screwed into the base 110 may be restored to an upright position.

The guide post body 120 may be simply screwed or fitted into the coupling part 111*a* protruding from the top center of the base 110, using the base coupling part 122 protruding from the bottom surface of the guide post body 120, and may protect the reflective sheets 130 by providing the reflective sheet adhering grooves 121 at a sufficient depth.

The reflective sheets 130 are adhered in multiple layers and thus may be immediately replaced when the reflective sheets 130 wear out.

Anchor bolts of a conventional road guide post directly receive external impact and thus are often detached from the ground due to external impact. The bracket 140 is used to solve the above problem. According to the present invention, the bracket 140 may evenly distribute external impact and thus external impact applied to the anchor bolts 10 fixed to the ground may be reduced.

In addition, the bracket 140 may be supported by the bracket fixing taps 112*c* provided on the bottom surface of the base 110 and thus detachment thereof due to external impact may be prevented. Alternatively, the bracket 140 may be coupled to the base 110 by the base fixing taps 142 of the bracket 140 and thus detachment thereof due to external impact may be prevented.

Figure 7:
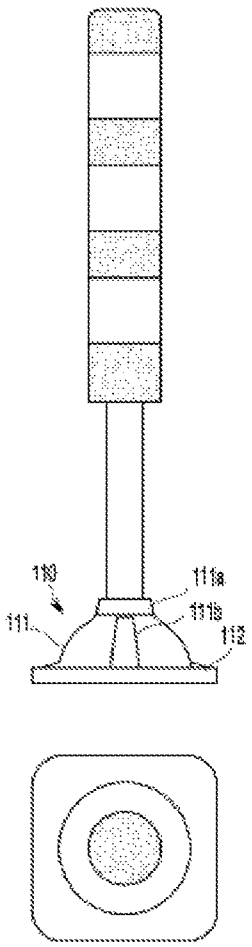
FIG. 7 is a view showing an example in which the base of the road guide post according to an embodiment of the present invention is applied to a movable road guide post.
Figure 8:
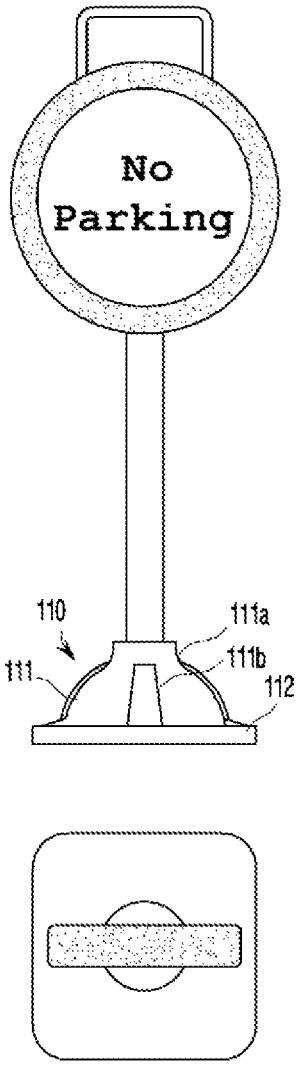
FIG. 8 is a view showing an example in which the base of the road guide post according to an embodiment of the present invention is applied to a no parking sign.
Figure 9:
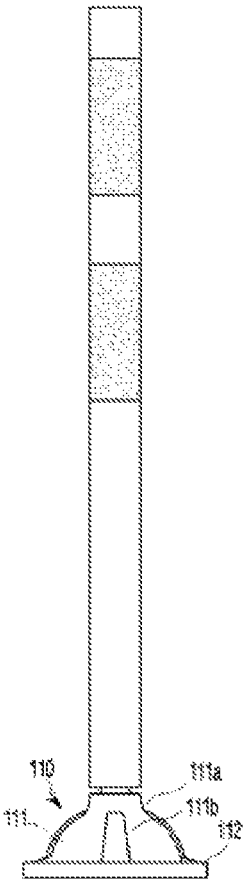
FIG. 9 is a view showing an example in which the base of the road guide post according to an embodiment of the present invention is applied to a spring-loaded resilient post.

Meanwhile, the base 110 corresponding to one of characteristic elements of the present invention may be applied to a variety of signs. FIG. 7 shows an example in which the base 110 used in the present invention is applied to a movable road guide post, FIG. 8 shows an example in which the base 110 used in the present invention is applied to a no parking sign, and FIG. 9 shows an example in which the base 110 used in the present invention is applied to a tubular marker used in the United States, Europe, etc.

While the present invention has been particularly shown and described with reference to embodiments thereof, it will be understood by one of ordinary skill in the art that various changes in form and details may be made therein without departing from the spirit and scope of the present invention as defined by the following claims.

The invention claimed is:

1. A road guide post comprising:

a base configured not to be broken and to maintain resilience even at extremely low temperature by means of injection-molding of a mixture in which synthetic rubber or low-density synthetic resin is mixed with an anti-hardening agent;

a guide post body configured with polyurethane so as to have restoring force on the basis of maintenance of resilience, configured as a rod-shaped body screwed or fitted into the base, and comprising reflective sheet adhering grooves provided on an upper outer surface of the rod-shaped body;

reflective sheets adhering in multiple layers to the adhering grooves;

a bracket inserted into and fixed to a bottom surface of the base;

wherein the base comprises:

a hemispherical base part which is configured to be a hemispherical body whose inside is hollow and which is configured to have a coupling part, formed to protrude at its upper center, to be screwed or fitted with the guide post body, and convex molded parts formed to protrude in the top to bottom direction of the hemispherical base part on the outer surface thereof so as to enhance restoring force, and a fastening part which has fastening holes integrally formed and extending downward on the hemispherical base part, and to protrude by extending outwardly, for fastening anchor bolts;

a bracket mounting groove formed under the fastening part for inserting and mounting the bracket, and bracket fixing taps formed to protrude on the bottom surface of the bracket for supporting and fixing the bracket inserted into the bracket mounting groove, and wherein the fastening part is formed on a lower end of the base and has the bracket fixing taps formed to protrude for supporting and fixing the bracket inserted into the bracket mounting groove, the bracket fixing taps preventing detachment of the bracket from the base, wherein the road guide post comprises a base coupling part formed to protrude on its bottom surface so as to be screwed or fitted into the base, and the reflective sheet adhering grooves have a depth of 10 to 15 mm such that the multiple layers of the reflective sheets may be prevented from protruding outwardly from the outer surface of the post;

wherein the reflective sheets are disposed in the reflective sheet adhering grooves in multiple layers wherein a long reflective sheet is wound multiple times, such that the reflective sheets may be cut off as much as is needed to be replaced, and wherein the bracket has fastening through holes for fastening the anchor bolts, is formed as a ring-shaped body wherein the bracket fixing taps are hook-shaped and are formed to be bent and protrude upwards from the ring-shaped body, the bracket fixing taps are provided with fastening holes arranged in line with the fastening through holes, and the bracket is made of any one selected from the group consisting of aluminum, stainless steel, or steel plated with zinc not only to enhance supporting force of the anchor bolts but also to prevent corrosion of the bracket.

* * * * *